US005519423A

United States Patent [19]

Moritz, III et al.

[11] Patent Number: 5,519,423

[45] Date of Patent: May 21, 1996

[54] TUNED ENTRANCE FANG CONFIGURATION FOR INK-JET PRINTERS

[75] Inventors: Jules G. Moritz, III; Kenneth Trueba; William Knight, all of Corvallis, Oreg.

[73] Assignee: Hewlett-Packard Company, Palo Alto, Calif.

[21] Appl. No.: 272,721

[22] Filed: Jul. 8, 1994

[51] Int. Cl.[6] ..... B41J 2/16

[52] U.S. Cl. ..... 347/65

[58] Field of Search ..... 347/65, 63, 44, 347/61

[56] References Cited

U.S. PATENT DOCUMENTS

| | | | |
|---|---|---|---|
| 4,338,611 | 7/1982 | Eida et al. | 347/63 |
| 4,882,595 | 11/1989 | Trueba et al. | 346/140 R |
| 5,308,442 | 5/1994 | Taub et al. | 156/644 |

FOREIGN PATENT DOCUMENTS

| | | | |
|---|---|---|---|
| 0314486A2 | 10/1988 | European Pat. Off. | B41J 3/04 |
| 056847A2 | 4/1993 | European Pat. Off. | B41J 2/04 |
| 0577383A3 | 6/1993 | European Pat. Off. | B41J 2/16 |
| 0439633 | 1/1990 | Germany | B41J 2/14 |

*Primary Examiner*—Benjamin R. Fuller
*Assistant Examiner*—Craig A. Hallacher

[57] ABSTRACT

A thermal ink-jet pen which includes a tuned printhead for ejecting droplets of ink onto a print medium is provided. The printhead comprises (a) a plurality of resistive elements, (b) a plurality of nozzles through which the droplets of ink are ejected, (c) a plurality of drop ejection chambers, (d) a plurality of ink feed channels, each provided with an entrance defined by a pair of projections on either side thereof, and (e) an ink refill slot operatively associated with the plurality of ink feed channels, the ink refill slot defined by an edge to provide a shelf from the edge to the ink feed channels. The plurality of resistive elements is divided into sets, with each resistive element staggered a different distance from the edge. Each ink feed channel within a set is provided with a different critical dimension value, the critical dimension comprising at least one selected from the group consisting of (1) width of entrance to channel, (2) width of the channel, (3) length of the channel, and (4) distance of the resistive element to the terminus of the channel. The critical dimension is related to distance of the resistive element from the edge. By providing each set of resistive elements with different widths, the damping of the pen is improved and all the nozzles have substantially the same refill speed.

24 Claims, 3 Drawing Sheets

TUNED ENTRANCE FANG CONFIGURATION FOR INK-JET PRINTERS

TECHNICAL FIELD

The present invention relates generally to ink-jet pens employed in thermal ink-jet printers, and, more particularly, to an improved printhead structure for introducing ink into the firing chambers from which the ink is ejected onto the print medium. The improved printhead structure improves damping of the pen, permitting all chambers to have substantially the same refill speed.

BACKGROUND ART

In the art of thermal ink-jet printing, it is known to provide a plurality of electrically resistive elements on a common substrate for the purpose of heating a corresponding plurality of ink volumes contained in adjacent ink reservoirs leading to the ink ejection and printing process. Using such an arrangement, the adjacent ink reservoirs are typically provided as cavities in a barrier layer attached to the substrate for properly isolating mechanical energy to predefined volumes of ink. The mechanical energy results from the conversion of electrical energy supplied to the resistive elements which creates a rapidly expanding vapor bubble in the ink above the resistive elements. Also, a plurality of ink ejection orifices are provided above these cavities in a nozzle plate and provide exit paths for ink during the printing process.

In the operation of thermal ink-jet printheads, it is necessary to provide a flow of ink to the thermal, or resistive, element causing ink drop ejection. This has been accomplished by manufacturing ink refill channels, or slots, in the substrate, ink barrier, or nozzle plate.

Current thermal ink-jet pen designs utilize a resistor multiplex pattern which allows the resistors to be "fired" at different times. Therefore, the resistors are offset spatially to compensate for this timing. These pens are fabricated by cutting the ink refill slot through a silicon substrate, which provides a vertical edge, or shelf, perpendicular to the print swath, while the resistors are staggered with respect to this edge, thereby creating different path lengths from the ink source or fill slot for each resistor.

The consequence of this design is that the entrance length (the distance from the edge of the shelf to the channel entrance on an individual chamber basis) varies from 61 μm to 94 μm, with the nominal shelf length of 40 μm on one particular commercial thermal ink-jet pen. Currently, all chambers have a 90° tapered fang residing between the slot and the channel. The line width frequency testing has shown that the refill speed varies between chambers, with the 61 μm entrance length producing a "faster" chamber than the 94 μm entrance length. Specifically, the nozzles with shortest entrance lengths are 350 Hz faster than those furthest from the slot.

The different path lengths offer varying resistance to ink flow and thus vary the time it takes to refill each resistor firing chamber. The chamber cannot be fired in a predictable manner until refill takes place. In addition, these varying resistances vary the damping of the chamber. If a chamber is over-damped, it is a slower structure than optimum and if under-damped, can cause nozzle instability resulting in spray, etc.

One possible solution is to etch the silicon shelf leading up to the inlet channel; see, e.g., application Ser. Nos. 08/009,151 and 08/009,181, both filed Jan. 25, 1993, and assigned to the same assignee as the present application. While that solution certainly provides a satisfactory result, it is nonetheless a costly process step.

Thus, there is a need to provide a mechanism for permitting all chambers to have the same refill speed, regardless of entrance length.

DISCLOSURE OF INVENTION

In accordance with the invention, each individual chamber is optimally tuned by varying one or more critical dimensions in the ink flow path, depending on distance of the resistor from the edge of the ink refill slot. The critical dimension may be any of the following: the width of the entrance to the ink feed channel, the width of the ink feed channel, the length of the ink feed channel, and/or the distance of the resistor to the opening to the terminus of the channel.

In the first embodiment (width of entrance to the ink feed channel), for example, chambers close to the ink refill slot have comparatively smaller channel openings, whereas those further away from the ink refill slot have comparatively wider openings. The chambers with the longest entrance lengths will use the largest width, while those with the shortest entrance length will use the smallest width. The only change required to the existing thermal ink jet pen design is the barrier mask. By so altering the widths, the damping of the pen is improved. Tuning the widths to compensate for the resistor multiplex pattern allows for all the nozzles to have the same refill speed.

In each of these embodiments, by tuning the indicated critical dimension with respect to the distance from the nozzle to the shelf, the impedance of all chambers can be balanced so as to provide substantially the same refill speed for all nozzles. These approaches all result in improved damping of the pen.

As an example, by reducing the widths (either entrance or channel) of certain nozzles, then nozzle-to-nozzle frequency variation can be reduced. As indicated above, the widths of the nozzles closest to the slot are considerably narrower than the prior art design, while those furthest away are essentially unchanged. As a result, the difference (frequency variation) between the closest and furthest nozzles is reduced from 350 Hz (prior art design) to only 50 Hz.

The thermal ink-jet pen of the present invention includes elements common to prior art pens, such as a printhead for ejecting droplets of ink onto a print medium, the printhead comprising (a) a plurality of resistive elements for heating ink supplied from a reservoir to generate the droplets of ink, (b) a plurality of nozzles through which the droplets of ink are ejected, with one nozzle associated with one resistive element, (c) a plurality of drop ejection chambers, each chamber enclosed on three sides by a barrier, each chamber having a floor supporting the resistive element, with the nozzle supported above the resistive element by said barrier, (d) a plurality of ink feed channels, each for supplying ink to one of the drop ejection chambers, and each ink feed channel provided with an entrance defined by a pair of projections on either side thereof, and (e) an ink refill slot operatively associated with the plurality of ink feed channels, the ink refill slot defined by an edge to provide a shelf from the edge to the entrances to the ink feed channels. The plurality of resistive elements is divided into sets, with a constant number of resistive elements per set, with each resistive element staggered a different distance from the edge. Each ink feed channel is provided with at least one different critical dimension (width of ink feed channel entrance, width of ink feed channel, length of ink feed channel, distance of resistor to the terminus of the channel. The width (entrance or channel) of the resistive element that is closer to the edge is narrower than the width of the resistive element that is further from the edge. The length of the channel of the resistive element that is closer to the edge is longer than the length of the channel of the resistive element that is further from the edge. The distance of resistor to the terminus of the channel for the resistive element that is closer to the edge is larger than that of the resistive element that is further from the edge.

The tuned critical dimensions of the present invention allows optimization of the architecture across the pen, allowing all nozzles to operate at an optimum damping factor, which in turn causes less ink spray and more uniform printing.

BEST MODES FOR CARRYING OUT THE INVENTION

Figure 1:
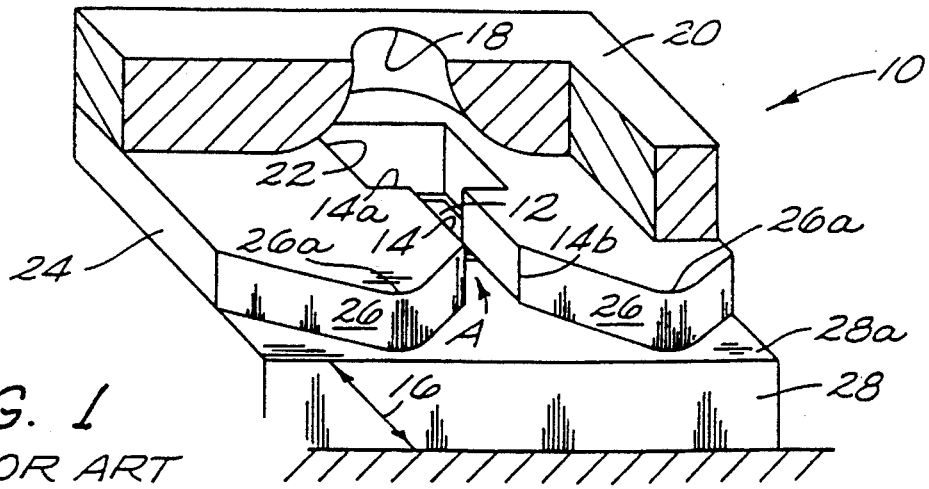
FIG. 1 PRIOR ART
FIG. 1 is a perspective view, depicting a single resistor element and associated components in a thermal ink-jet pen.

Referring now to the drawings wherein like elements of reference designate like elements throughout, a single resistor element 10 is .shown in FIG. 1, comprising a resistor 12 situated at one end 14*a* of an ink feed channel 14. Ink (not shown) is introduced at the opposite end 14*b* thereof, as indicated by arrow "A", from a plenum, or ink refill slot, indicated generally at 16. Associated with the resistor is a nozzle 18, located above the resistor 12 in a nozzle plate 20. The resistor 12 is energized by means not shown to fire a bubble of ink through the nozzle (i.e., normal to the surface of the resistor).

The resistor 12 is located in a firing chamber 22 at the terminus 14*a* of the ink feed channel 14. Both the chamber 22 and the ink feed channel 14 are formed in a barrier material 24, which advantageously comprises a photoresist material. The photoresist material is processed, using conventional photolithographic techniques, to define the chamber 22 and ink feed channel 14.

Fangs, or lead-in lobes, 26, one on each side of the entrance to the ink feed channel 14, serve to prevent bubbles in the ink from residing in the ink refill slot area and act to guide any such bubbles into the firing chamber 22, where they are purged during firing of the resistor 12. The fangs terminate in fang tips 26*a*. Such fangs are disclosed and claimed in U.S. Pat. No. 4,882,595, assigned to the same assignee as the present application.

Figure 2:
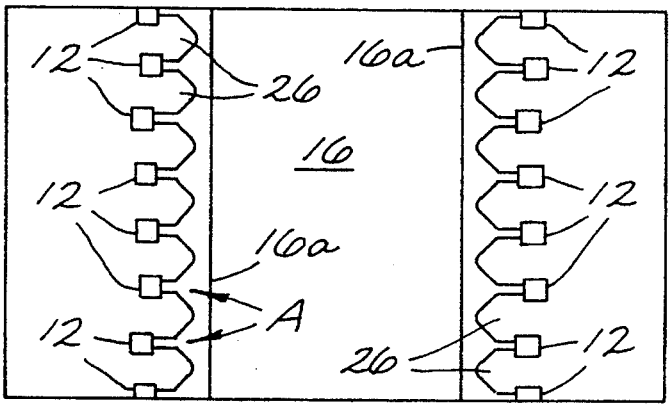
FIG. 2 PRIOR ART
FIG. 2 is a top plan view of a plurality of such resistor elements, comprising a portion of a printhead in the pen of FIG. 1.

A plurality of such resistors 12 and associated nozzles 18 are used to form a printhead. FIG. 2 depicts a prior art pen design, in which two rows of a plurality of resistors 12 are provided, one on either side of the ink refill slot 16. In this prior art design, all resistors 12 are staggered a different distance from the ink refill slot 16, yet are supplied with ink from a common source of ink. While not shown in FIG. 2, the fang tips 26*a* are also staggered from the ink refill slot 16 in the prior art design.

Figure 3:
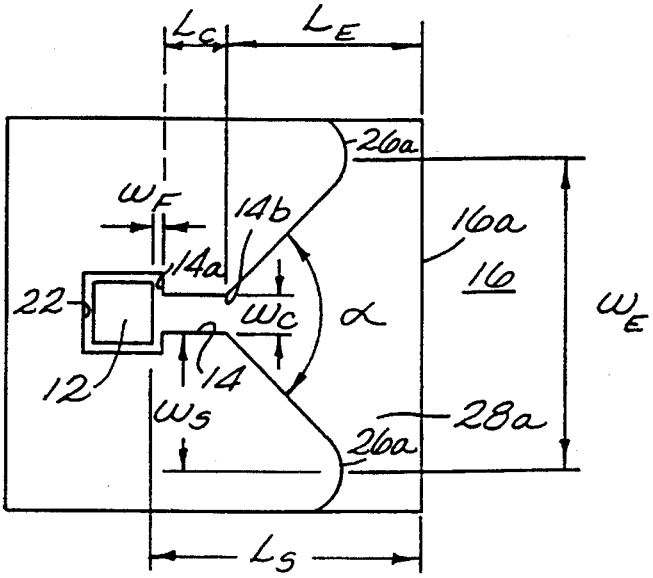
FIG. 3 is a top plan view of one resistor element, for definitional purposes.

FIG. 3 provides a visual description of terms employed in this application. Entrance length $L_E$ is the distance from the edge 16*a* of the ink refill slot 16 to the beginning of the ink feed channel 14. Shelf length $L_S$ is the distance from the resistor 12 to the edge 16*a* of the shelf 28*a*. Entrance width $W_E$ is measured between fang tips 26*a*, while channel width $W_C$ is the width of the ink feed channel 14 itself, as defined by the walls of the barrier 24. Channel length $L_C$ is the length of the ink feed channel 14, from its channel entrance 14*b* to its terminus 14*a*. Distance $W_F$ is the distance from the resistor 12 to the entrance to the resistor chamber 22, defined by the terminus 14*a* of the channel 14, also called the "front wall". The included angle $\alpha$ is relative to the edges of the fangs 26. Shelf 28*a* refers to the top of the substrate 28 exposed by removal of the barrier material 24 in defining the fangs 26 and other features of the resistor element 10.

Assuming a constant shelf length $L_S$, there are four parameters, or critical dimensions, that can be varied in accordance with the present invention to tune all nozzles in the pen to operate-at an optimum damping factor. These parameters include varying the channel entrance width $W_E$, the channel width $W_C$, the channel length $L_C$, and the resistor-to-front wall distance $W_F$. One or more of these parameters may be varied to provide the optimum damping factor. Tuning of each of these parameters is discussed in further detail below.

Tuning by Varying Channel Entrance Width $W_E$

It is instructive to examine prior art solutions to chamber refill and damping in thermal ink-jet pen designs. The previous (default) approach has a constant 90° entrance angle and lets the fang tips fall as they may. FIGS. 1 and 2 illustrate this approach, showing a plurality of firing chambers, each a different distance from the edge of the ink refill slot 16, thereby providing a different entrance length $L_E$. These prior art pen designs employ a repeating pattern of 13 staggered firing chambers 22.

One of the first observations of testing such pens as shown in FIG. 2 was that the maximum operating frequency of individual nozzles tended to follow the nozzle stagger pattern. Without subscribing to any particular theory, the following hypothesis was developed: Since the nozzles closest to the ink refill slot 16*a* (thus, reduced entrance length $L_E$) have less entrained mass and lower viscous drag than the nozzles furthest away, then the nozzles closest to the ink refill slot 16 can refill quicker. As a first attempt at using the entrance area to compensate for nozzle-to-nozzle variation, a laminar flow spreadsheet model was developed.

Although this model was in no means a complete analysis, it did show the feasibility of tuning the entrances. Subsequently, it became possible to predict that refill rate was correlated to both entrance length $L_E$ width $W_E$ (these terms are shown in FIG. 3).

The theory behind this approach was that the nozzles which reside closest to the ink refill slot 16 (and thus have the shortest entrance length $L_E$) could be slowed down by narrowing their entrance widths $W_E$, while those furthest away would remain essentially unchanged. A barrier matrix mask was designed with four tuned entrance designs as well as the default prior art design. After the pens were built, they were measured using a linewidth frequency response technique.

The default, or prior art, pen design was included in this study for comparison purposes. As shown in FIG. 2, the default design has a constant 90° included angle on all of the entrances. Leveraging previous experiments on this family of pens, the nozzles closest to the ink refill slot 16 were expected to be faster than those furthest away. FIG. 2 illustrates that there is a constant 90° included angle on all of the default prior art entrances, regardless of entrance length $L_E$.

Figure 4:
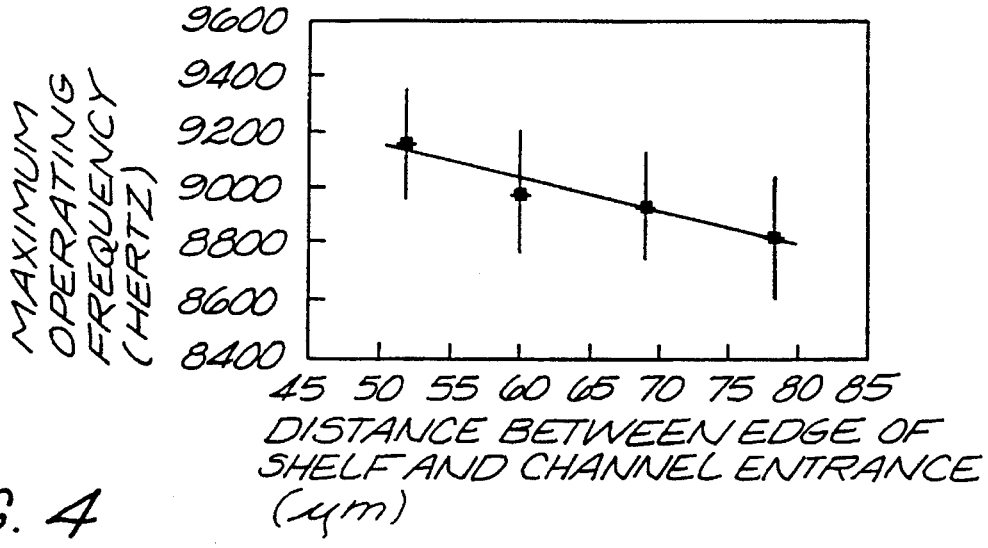
FIG. 4, on coordinates of frequency (in Hertz) and distance (in μm), is a plot of the maximum operating frequency as a function of the distance between the edge of the shelf and the channel entrance for a prior art design.

Using the linewidth frequency response measurement technique, data was collected for individual nozzle response. Displayed in FIG. 4, the nozzles closest to the ink refill slot 16 were faster than those furthest away. The squares in the Figure denote average values; the vertical bars denote 95% confidence levels.

Figure 5:
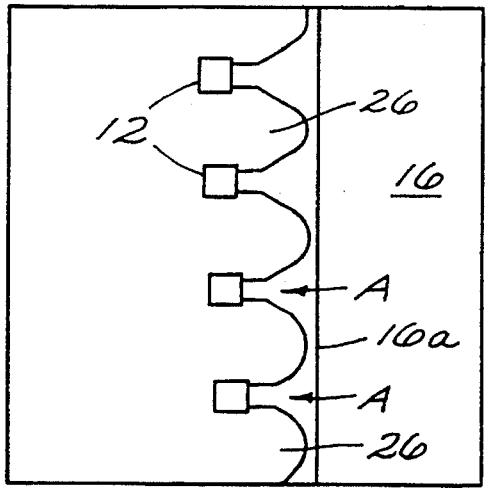
FIG. 5 is a top plan view of a quartet of resistor elements, employing a design in accordance with the present invention in which the width of the entrance to the ink feed channel is varied as a function of shelf length.

As mentioned previously, this work was based on the idea that the nozzles closest to the slot could be restricted by narrowing their entrance widths $W_E$, while those furthest away would remain essentially unchanged. The concept was that all nozzles would have the same refill rates as the slowest nozzles. Since this would result in a lower average frequency of the pen, these designs were built with both the default 1 mil and thicker 1.1 mil barrier 24 to preserve operating speed. According to the computational modeling results, the tuned entrance design of the present invention, shown in FIG. 5, was determined to be the most likely candidate for success. In FIG. 5, the nozzle at the upper portion of the Figure has the longest entrance length $L_E$. However, the nozzle closest to the slot (at the lower portion) has a considerably narrower entrance width $W_E$ than the default design shown in FIG. 2.

Figure 6:
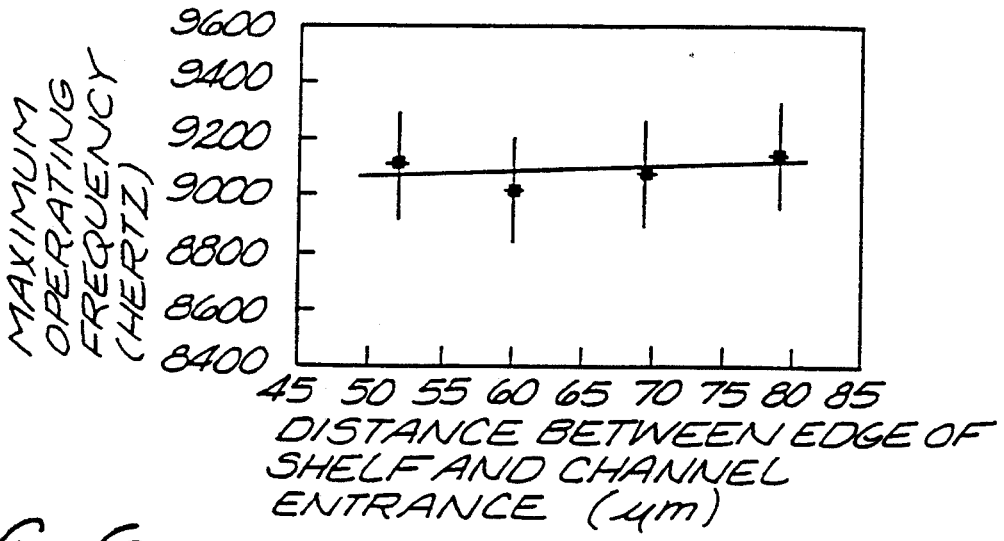
FIG. 6, on coordinates of frequency (in Hertz) and distance (in μm), is a plot similar to that of FIG. 4, but based on the design depicted in FIG. 5.

Data was again gathered for individual nozzle response using linewidth frequency response measurement. As shown in FIG. 6, the difference in maximum operating frequency between the nozzles closest to the shelf and those furthest away was considerably less than the default design. The slope of the line is considerably less than for the default design (shown in FIG. 2). The squares and vertical bars have the same meaning as in FIG. 4.

The results shown in FIG. 6 indicate that there was still some nozzle-to-nozzle variation present in even the most optimistic design. Nevertheless, the matrix mask included a large experimental design space. By analyzing individual nozzles for maximum operating frequency (in Hertz) as a function of barrier thickness t (measured in mils), entrance length $L_E$ (measured in μm), and entrance width $W_E$ (measured in μm), a 0.97 correlation coefficient was found:

$$Frequency=23300*t-91.2*L_E+32.1*W_E-13800$$

Using this formula, a fully populated tuned entrance barrier mask for the pen has been designed.

Although the present work examined only a particular pen design, tuned entrances can be applied to any of the slot-feed pen designs. Since this concept minimizes nozzle-to-nozzle variation without changing resistor, orifice, or channel dimensions, adaptation is expected to be relatively straight forward. The aforementioned formula can be reduced as follows:

$$W_E=2.84L_E+Constant$$

In order to determine the value of the constant, one inputs the default dimensions of the nozzle furthest from the slot. For the particular pen configuration discussed herein, these values are 82 μm long by 198 μm wide, which yields a constant of −35 μm. To find desired entrance widths for the other nozzles, all that is required is to insert their entrance lengths in the reduced formula above. As an example, the first nozzle of the set of nozzles in the particular pen configuration discussed herein has an entrance length of 57 μm and thus 2.84*57−35= 127, which thus provides an entrance width of 127 μm on the fully populated barrier mask.

In some pen designs, there simply is not enough real-estate in between the nozzles to implement tuned entrances. There are three alternatives to compensate for nozzle-to-nozzle variation, which are now discussed.

Tuning by Varying Channel Width $W_C$

In the second embodiment, the channel width can be varied. Nozzles closest to the shelf should have narrower channel widths $W_C$ than those furthest away. For a maximum shelf length of 130 μm, the channel width is preferably given by $$W_C=0.7222*L_S-42.89$$

while for a maximum shelf length of 160 μm, the channel width is preferably given by $$W_C=0.7222*L_S-64.56$$

Figure 7:
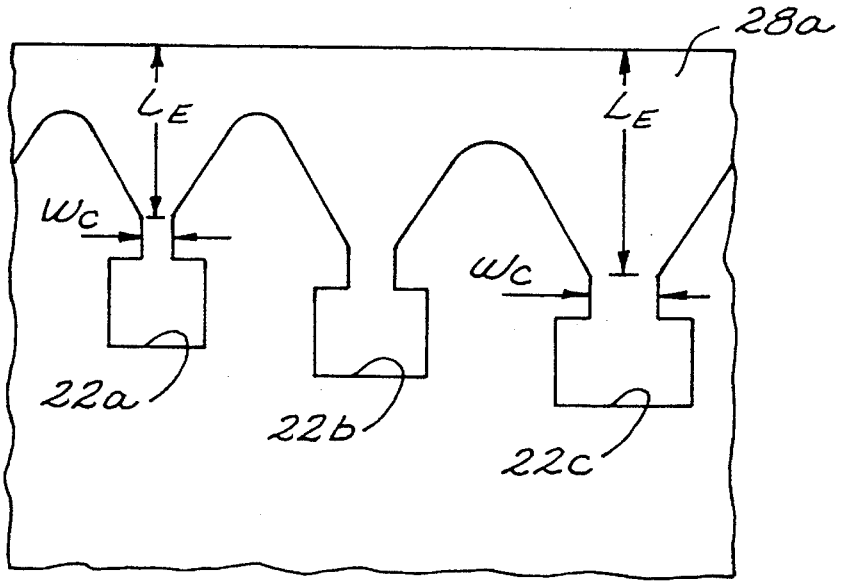
FIG. 7 is a top plan view of a portion of a printhead, depicting an alternate embodiment of the present invention, in which the width of the ink feed channel is varied as a function of shelf length.

In this embodiment, the width $W_C$ of the ink feed channel itself is varied. FIG. 7 depicts the tuned configuration for a set of three staggered resistor elements.

Since refill time varies as a result of the nozzle offset for multiplexing nozzle firing, tuning is accomplished by providing different widths of the ink feed channels. Specifically, longer channels have wider spacing. The relationship between refill time $t_R$ and channel length $L_C$ and channel width $W_C$ is given by $$t_R \propto L_c/W_C$$

Tuning by Varying Channel Length $L_C$

In addition to the previous compensation methods, channel length $L_C$ can also be used to remove nozzle-to-nozzle variations. Longer channels produce slower chambers. Thus, nozzles closest to the shelf have long channels, while those further away should have short channels.

For a maximum shelf length of 130 μm, the channel length is preferably given by $$L_C=-0.7222*L_S+97.89$$

while for a maximum shelf length of 160 μm, the channel length is preferably given by $$L_C=-0.8056*L_S+132.9$$

Tuning by Varying Front Wall Distance $W_F$

Yet another alternative to balancing the impedance of the various chambers is to change the front wall distance $W_F$. According to modeling and thermal ink-jet history, a large front wall produces a slower nozzle. Therefore, by having a large front wall on the nozzles closest to the shelf, and a small front wall on those furthest away, the chambers will have minimal refill variation. For a shelf length of 130 μm and front wall distance $W_F$, values ranging from 8 to 34 μm, the front wall distance is preferably given by $$W_F=-0.7222*L_S+101.9$$

while for a shelf length of 160 μm and front wall distance, $W_F$, values ranging from 8 to 64 μm, the front wall distance is preferably given by $$W_F=-1.556*L_S+256.9$$

In another alternative and using modeling data, sets of resistors 12, comprising 22 resistors per set, were designed in which the distance from the resistor to the front wall, $W_F$, varied from 8 to 75.75 μm. The shelf length $L_S$ varied from 160 μm (at a front wall distance of 8 μm) to 123.75 (at a front wall distance of 75.75 μm). The following relation was developed to provide an essentially zero variation in refill frequency:

$$W_F=-1.865*L+Constant$$

For the particular pen design discussed above, the value of the constant is 306.5.

The model predicts a variation in refill frequency of about 3 kHz (for a nominally 8 kHz pen) where the first wall distance $W_F$ is kept constant at 8 μm and the shelf length $L_S$ is 130 μm.

EXAMPLES

Examples 1–12

Computer modeling results were run to determine the effects of varying one or two critical dimensions while holding other critical dimensions constant. Examples 1–6 are directed to a pen design having a maximum shelf length of 130 μm, while Examples 7–12 are directed to a pen design having a maximum shelf length of 160 μm.

In each case, the maximum and minimum shelf length $L_S$ are listed, along with the corresponding channel width $W_C$, the front wall distance $W_F$, and the channel length $L_C$. The dimensions are in units of μm. The resulting pen refill frequency f, in Hertz, is listed for each case.

| $L_S$ | $W_C$ | $W_F$ | $L_C$ | f |
|---|---|---|---|---|
| Maximum Shelf of 130 μm. | | | | |
| Example 1: No Compensation | | | | |
| 94 | 25 | 8 | 4 | 16,095 |
| 130 | 25 | 8 | 4 | 8,667 |
| Example 2: Channel Width Compensation | | | | |
| 94 | 25 | 8 | 4 | 16,095 |
| 130 | 51 | 8 | 4 | 9,358 |
| $W_C = 0.7222*L_S - 42.89$ | | | | |
| Example 3: Front Wall Compensation | | | | |
| 94 | 25 | 34 | 4 | 13,043 |
| 130 | 25 | 8 | 4 | 8,667 |
| $W_F = -0.7222*L_S + 101.9$ | | | | |
| Example 4: Channel Length Compensation | | | | |
| 94 | 25 | 8 | 30 | 9,394 |
| 130 | 25 | 8 | 4 | 8,667 |
| $L_C = -0.7222*L_S + 97.89$ | | | | |
| Example 5: Channel Width and Front Wall Compensation | | | | |
| 94 | 25 | 34 | 4 | 13,043 |
| 130 | 51 | 8 | 4 | 9,358 |
| Example 6: Channel Width and Channel Length Compensation | | | | |
| 94 | 25 | 8 | 30 | 9,394 |
| 130 | 51 | 8 | 4 | 9,358 |
| Maximum Shelf Length of 160 μm. | | | | |
| Example 7: No Compensation | | | | |
| 134 | 25 | 8 | 4 | 9,389 |
| 160 | 25 | 8 | 4 | 6,260 |
| Example 8: Channel Width Compensation | | | | |
| 124 | 25 | 8 | 4 | 9,389 |
| 160 | 51 | 8 | 4 | 7,042 |
| $W_C = 0.7222*L_X - 64.56$ | | | | |
| Example 9: Front Wall Compensation | | | | |
| 124 | 25 | 64 | 4 | 7,575 |
| 160 | 25 | 8 | 4 | 6,260 |
| $W_F = -1.556*L_S + 256.9$ | | | | |
| Example 10: Channel Length Compensation | | | | |
| 124 | 25 | 8 | 33 | 6,244 |
| 160 | 25 | 8 | 4 | 6,260 |
| $L_C = -0.8056*L_S + 132.9$ | | | | |
| Example 11: Channel Width and Front Wall Compensation | | | | |
| 124 | 25 | 64 | 4 | 7,575 |
| 160 | 51 | 8 | 4 | 7,042 |
| Example 12: Channel Width and Channel Length Compensation | | | | |
| 124 | 25 | 8 | 23 | 7,060 |
| 160 | 51 | 8 | 4 | 7,042 |

From the foregoing results, it is clear that varying at least one of the critical dimensions improves the pen performance by reducing the difference in refill frequency between the two shelf lengths listed. Varying two of the critical dimensions provides even further improvement.

Examples 13–14

The effect of channel width on nozzle frequency is shown in the Table below for two resistor sizes, 52 μm and 55 μm. Local refill refers to the frequency at which one nozzle firing will refill with ink, while global refill refers to the frequency at which all nozzles firing will refill with ink.

| Resistor Size | Channel Width | Local Refill | Global Refill |
|---|---|---|---|
| Example 13: | | | |
| 52 μm | 30 μm | 6200 Hz | 5200 Hz |
| 52 μm | 40 μm | 6300 Hz | 5350 Hz |
| 52 μm | 50 μm | 6400 Hz | 5450 Hz |
| Example 14: | | | |
| 55 μm | 30 μm | 5500 Hz | 4650 Hz |
| 55 μm | 40 μm | 5900 Hz | 4700 Hz |
| 55 μm | 50 μm | 6100 Hz | 4750 Hz |

It will be seen that for a resistor size of 52 μm, the nozzle frequency is substantially constant for all channel widths. This Table also shows for a larger resistor, more ink is ejected, resulting in a lower frequency response to refill the chamber. Further, for the larger resistor, the channel width has more of an effect on the refill frequency.

INDUSTRIAL APPLICABILITY

The tuned entrance fang configuration of the present invention is expected to find use in future thermal ink-jet printers.

Thus, there has been disclosed a tuned entrance fang configuration in thermal ink-jet printheads. It will be readily apparent to those skilled in this art that various changes and modifications of an obvious nature may be made, and all such changes and modifications are considered to fall within the scope of the invention, as defined by the appended claims.

What is claimed is:

1. A thermal ink-jet pen including a printhead for ejecting droplets of ink onto a print medium, said printhead comprising (a) a plurality of resistive elements for heating ink supplied from a reservoir to generate said droplets of ink, (b) a plurality of nozzles through which said droplets of ink are ejected, with one nozzle associated with one resistive element, (c) a plurality of drop ejection chambers, each chamber enclosed on three sides by a barrier, each chamber having a floor supporting said resistive element, with said nozzle supported above said resistive element by said barrier, (d) a plurality of ink feed channels, each for supplying ink to one said drop ejection chamber through an entrance on a fourth side of said chamber, each ink feed channel having a length $L_C$, and each ink feed channel provided with an entrance defined by a pair of projections on either side thereof, each said entrance having a length $L_E$, and (e) an ink refill slot operatively associated with said plurality of ink feed channels, said ink refill slot defined by an edge to provide a shelf from said edge to said plurality of ink feed channels, wherein said plurality of resistive elements is divided into sets, with each resistive element staggered a different distance from said edge, said distance being the sum of $L_C$ and $L_E$, wherein each ink feed channel within a set is provided with a different critical dimension value, said critical dimension comprising at least one selected from the group consisting of (1) width of said entrance to said channel, (2) width of said channel, (3) length of said channel $L_C$, and (4) distance of said resistive element to said entrance of said chamber, and wherein said critical dimension is related to distance of said resistive element from said edge.

2. The thermal ink-jet pen of claim 1 wherein said width of said channel entrance is measured between projections defining a particular ink feed channel.

3. The thermal ink-jet pen of claim 2 wherein said resistive elements comparatively closer to said edge have a narrower width of said channel entrance to said ink feed channel than resistive elements comparatively further from said edge.

4. The thermal ink-jet pen of claim 2 wherein said pen operates at a frequency given by the following equation:

$$f=23300*t-91.2*L_E+32.1*W-13800$$

where t is thickness of said barrier, $L_E$ is said distance from said shelf to said channel entrance of said ink feed chamber, and $W_E$ is said width of said entrance to said ink feed channel.

5. The thermal ink-jet pen of claim 3 wherein said width is given by:

$$W_E=2.84*L_E+Constant$$

wherein said Constant depends on a particular pen configuration.

6. The thermal ink-jet pen of claim 5 wherein said Constant has the value −35.

7. The thermal ink-jet pen of claim 1 herein said width of said channel is measured between walls of said barrier defining a particular ink feed channel.

8. The thermal ink-jet pen of claim 7 wherein said resistive elements comparatively closer to said edge have a narrower width of said channel than resistive elements comparatively further from said edge.

9. The thermal ink-jet pen of claim 8 wherein said channel width is given by:

$$W_C=0.7222*L+Constant$$

10. The thermal ink-jet pen of claim 9 wherein said Constant has a value of −42.89 for a maximum shelf length of 130 μm.

11. The thermal ink-jet pen of claim 9 wherein said constant has a value of −64.56 for a maximum shelf length of 160 μm.

12. The thermal ink-jet pen of claim 1 wherein said length of said channel is measured along a wall of said barrier defining a particular ink feed channel.

13. The thermal ink-jet pen of claim 12 wherein said resistive elements comparatively closer to said edge have a longer length of said channel than resistive elements comparatively further from said edge.

14. The thermal ink-jet pen of claim 13 wherein said channel length is given by:

$$L_C=-0.7222*L_S+Constant$$

for a maximum shelf length of 130 μm.

15. The thermal ink-jet pen of claim 14 wherein said Constant has a value of 97.89.

16. The thermal ink-jet pen of claim 13 wherein said channel length is given by:

$$L_C=-0.8056*L_S+Constant$$

for a maximum shelf length of 160 μm.

17. The thermal ink-jet pen of claim 16 wherein said Constant has a value of 132.9.

18. The thermal ink-jet pen of claim 1 wherein said distance of said resistive element to said fourth side of said chamber is measured from an edge of said resistive element closest to said fourth side of said chamber.

19. The thermal ink-jet pen of claim 18 wherein said distance of said resistive element to said fourth side of said chamber, $W_F$, is given by:

$$W_F=-0.7222*L_S+Constant$$

where $L_S$ is said distance of said resistive element to said edge of said ink refill slot.

20. The thermal ink-jet pen of claim 19 wherein said Constant has the value 101.9.

21. The thermal ink-jet pen of claim 18 wherein said distance of said resistive element to said entrance to said chamber, $$W_F=-1.556*L_S+Constant$$

where $L_S$ is said distance of said resistive element to said edge of said ink refill slot.

22. The thermal ink-jet pen of claim 21 wherein said constant has the value 256.9.

23. The thermal ink-jet pen of claim 18 wherein said distance of said resistive element to said entrance to said chamber, $W_F$, is given by:

$$W_F = -1.865 * L_S + Constant$$

where $L_S$ is said distance of said resistive element to said edge of said ink refill slot.

24. The thermal ink-jet pen of claim 23 wherein said constant has the value 306.5.

* * * * *